US006899169B1

(12) United States Patent
Cox

(10) Patent No.: US 6,899,169 B1
(45) Date of Patent: May 31, 2005

(54) PLASTIC HEAT EXCHANGER

(76) Inventor: Richard D. Cox, 40824 Coventry, Novi, MI (US) 48375

( * ) Notice: Subject to any disclaimer, the term of this patent is extended or adjusted under 35 U.S.C. 154(b) by 13 days.

(21) Appl. No.: 10/884,320

(22) Filed: Jul. 2, 2004

(51) Int. Cl.[7] ..... F28D 7/00; F28F 9/02; F28F 7/00

(52) U.S. Cl. ..... 165/159; 165/158; 165/157; 165/76; 165/174

(58) Field of Search ..... 165/157, 158, 165/159, 162, 173, 174, 175, 178, 76–79, 153; 422/201; 285/41

(56) References Cited

U.S. PATENT DOCUMENTS

| | | | | |
|---|---|---|---|---|
| 2,075,511 A | | 3/1937 | DeBaufre | |
| 2,213,410 A | * | 9/1940 | Rathburn | 165/76 |
| 2,343,542 A | | 3/1944 | Faunce | |
| 2,466,525 A | | 4/1949 | Wilson | |
| 3,187,810 A | | 6/1965 | Helin | |
| 3,228,456 A | | 1/1966 | Brown | |
| 3,277,959 A | | 10/1966 | Withers | |
| 3,301,321 A | * | 1/1967 | Poore | 165/178 |
| 3,326,279 A | | 6/1967 | Eisberg | |
| 3,363,680 A | | 1/1968 | Baker | |
| 3,572,429 A | | 3/1971 | Myers | |
| 3,669,185 A | * | 6/1972 | Bare | 165/158 |
| 3,804,161 A | | 4/1974 | Nowak | |
| 3,850,230 A | | 11/1974 | Margen | |
| 4,105,065 A | * | 8/1978 | Chirico | 165/78 |
| 4,345,549 A | * | 8/1982 | Colmano | 165/158 |
| 4,576,223 A | | 3/1986 | Humpolik | |
| 4,589,478 A | * | 5/1986 | Wunder | 165/76 |
| 4,735,261 A | | 4/1988 | Huebner | |
| 4,848,448 A | * | 7/1989 | Kaarre | 165/158 |
| 4,871,014 A | * | 10/1989 | Sulzberger | 165/76 |
| 4,972,903 A | | 11/1990 | Kwok | |
| 5,004,042 A | | 4/1991 | McMorries | |
| 5,333,681 A | * | 8/1994 | Jullien et al. | 165/82 |
| 5,518,066 A | | 5/1996 | Francis | |
| 5,746,270 A | | 5/1998 | Schroeder et al. | |
| 5,823,251 A | | 10/1998 | Romero | |
| 6,206,086 B1 | | 3/2001 | McKey | |
| 6,311,678 B1 | | 11/2001 | Lepoutre | |

FOREIGN PATENT DOCUMENTS

| | | |
|---|---|---|
| FR | 2542438 | 9/1984 |
| FR | 2785375 | 5/2000 |
| WO | WO 02/44641 | 6/2002 |

* cited by examiner

*Primary Examiner*—Tho V. Duong
(74) *Attorney, Agent, or Firm*—Andrew W. Ludy

(57) ABSTRACT

A shell and tube heat exchanger has two shell coolant and two tube coolant passageways communicating with a cavity in a shell. Removably received in the shell cavity is a tube bundle with tube headers. A locating screw extends through the shell to engage a locating recess in one tube header. The screw locates the tube bundle angularly about the central axis and longitudinally along the central axis, and is also used to electrically ground the tube bundle. An end cover, a flow separator, and resilient disc to take up thermal expansion are installed in each end of the shell to direct coolant through the tube bundle in multiple passes. Receivers with rotatable connectors are bonded to each shell coolant and tube coolant passageway. Angled connector nozzles can be connected to external conduits in any orientation.

37 Claims, 8 Drawing Sheets

PLASTIC HEAT EXCHANGER

CROSS-REFERENCE TO RELATED APPLICATIONS

Not applicable.

STATEMENT REGARDING FEDERALLY SPONSORED RESEARCH FOR DEVELOPMENT

Not applicable.

BACKGROUND OF THE INVENTION

This invention relates to the field of heat exchangers, and more particularly to a shell and tube heat exchanger with plastic components.

Shell and tube heat exchangers are commonly used with marine engines for cooling. For use in seawater, they isolate the engine cooling system from the corrosive effects of the salt water. They are also found on stationary auxiliary generators, and in industrial and chemical process plants. Engine cooling systems typically use a mixture of ethylene glycol and de-ionized water as coolant. Ambient cooling water may be salty or fresh. Shell and tube heat exchangers are well known, and have taken a variety of configurations in the past. Some examples of heat exchangers in the prior art are shown in the following patents:

Schroeder, U.S. Pat. No. 5,746,270, discloses a metal body 54 with an outer wall 56. The ends of the outer wall 56 project inward to form a flange. This prevents removal of the tube bundle 60. It also precludes preassembly of the tube bundle as a module. The metal tubes are inserted into the body 54, and then welded together at their ends, the weld 61 forming a tube header.

McMorries, IV, U.S. Pat. No. 5,004,042, illustrates a tube bundle 46 with metal tubes 48 mounted in a plastic tube base (header) 58. Plastic end caps 94 and 96 are sealed against the header 58 by first O-rings 146, and against the shell 92 by second O-rings 148. Separator plates 86 to direct flow are integral with the end caps 92 and 96.

Helin, U.S. Pat. No. 3,187,810, shows tubes 21 mounted in a fixed header and a slideable header 19 to allow for expansion. Header 19 is sealed against shell flange 11 and head flange 15 by sealing rings 29 and 31, and packing 39 and 41, set into recess 37.

Myers, U.S. Pat. No. 3,572,429, discloses a shell 8 comprised of hubs 12 and14 welded to tubular member 10. Tubes 24 are mounted in fixed header 26 and slideable header 28 to allow for expansion. The tube/header bundle is removable from the shell 8. Two O-rings 42 and 44 are set into grooves in each hub 12 and 14 to seal the slideable header 28 to the shell 8. Inspection hole 72 between the O-rings 42 and 44 allows leak detection. Construction is all metal.

In all of the above devices, the inlet and outlet nozzles for both coolant and seawater are either welded to the shell and end caps, or are integrally cast. In no case is there provision for easy alignment and mounting of the nozzles. Nor can the location of the nozzles be changed without expensive tooling changes. In the prior-art devices, the separators are cast or welded integrally with the end caps or with the shell. In no prior-art invention can the separators be easily exchanged for new separators having either more or fewer dividers for more or fewer passes through the tube bundle, respectively. In the above-described devices, no means is shown for sealing the separator dividers against leakage at both the end caps and the headers. No means is provided for sealing the separator dividers against leakage during thermal expansion. None of the prior-art inventions have provision for grounding a metal tube bundle to the engine.

Accordingly, there is a need to provide a shell and tube heat exchanger that has inlet and outlet nozzles that can be located in various positions, and can be easily aligned and mounted.

There is a further need to provide a heat exchanger of the type described, in which the tube bundle, nozzles, end covers, and separators will be removable for cleaning or replacement.

There is yet a further need to provide a heat exchanger of the type described and that will provide separators of various divider plate configurations that are easy to install and service.

There is a still further need to provide a heat exchanger of the type described and that will provide for sealing the separator plates against leakage at both the end caps and the headers, even in the event of thermal expansion.

There is another need to provide a heat exchanger of the type described and that will provide for grounding and metal tube bundle to the engine.

This is yet another need to provide a heat exchanger of the type described and that will provide high thermal efficiency There is still another need to provide a heat exchanger of the type described and that can be manufactured cost-effectively in large quantities of high quality.

BRIEF SUMMARY OF THE INVENTION

In accordance with the present invention, there is provided a shell and tube heat exchanger for transferring heat between a shell coolant and a tube coolant. The heat exchanger has first and second shell coolant passageways and first and second tube coolant passageways to conduct the coolants. The heat exchanger comprises a shell having a central axis, and extending between opposite first and second ends. The shell has a well extending around a periphery and defining a shell cavity therein. The first and second shell coolant passageways pass through the shell wall adjacent the shell first and second ends, respectively. The shell has at least one threaded locating hole through the shell wall.

A first tube header and a second tube header are provided, each having an outer periphery. The first and second headers are spaced apart and generally parallel. At least one header periphery has a locating recess.

A plurality of generally straight and parallel tubes extend between the first and second headers. The tubes have first and second opened ends attached to and penetrating the first and second headers, respectively.

The first tube header, the second tube header, and the tubes comprise a tube bundle. The tube bundle is removably received within the shell cavity with the first header adjacent the shell first end, and the second header adjacent the shell second end. The header locating recess is juxtaposed with the threaded locating hole.

A locating screw extends between opposite proximal and distal ends, and engages the threaded locating hole. The locating screw proximal end engages the locating recess. The locating screw is adapted to locate the tube bundle angularly about the central axis and longitudinally along the central axis in a predetermined alignment with the shell.

A first end cover is removably attached to the shell first end. A second end cover is removably attached to the shell second end. The first and second end covers each have an inside surface.

The shell cavity includes a first chamber extending between the first tube header and the first end cover, and a second chamber extending between the second tube header and the second end cover. The first and second tube coolant passageways are in communication with the first and second chambers respectively. The tube first and second open ends are in communication with the first and second chambers respectively. This allows passage of the tube coolant between the first and second chambers through the tubes.

O-rings are provided for slideably sealing the first and second headers to the shell. O-rings are also provided for sealing the first and second end covers to the shell.

BRIEF DESCRIPTION OF THE SEVERAL VIEWS OF THE DRAWING

The invention will be more fully understood, while still further objects and advantages will become apparent, in the following detailed description of preferred embodiments thereof illustrated in the accompanying drawing, in which.

DETAILED DESCRIPTION OF THE INVENTION

Figure 1:
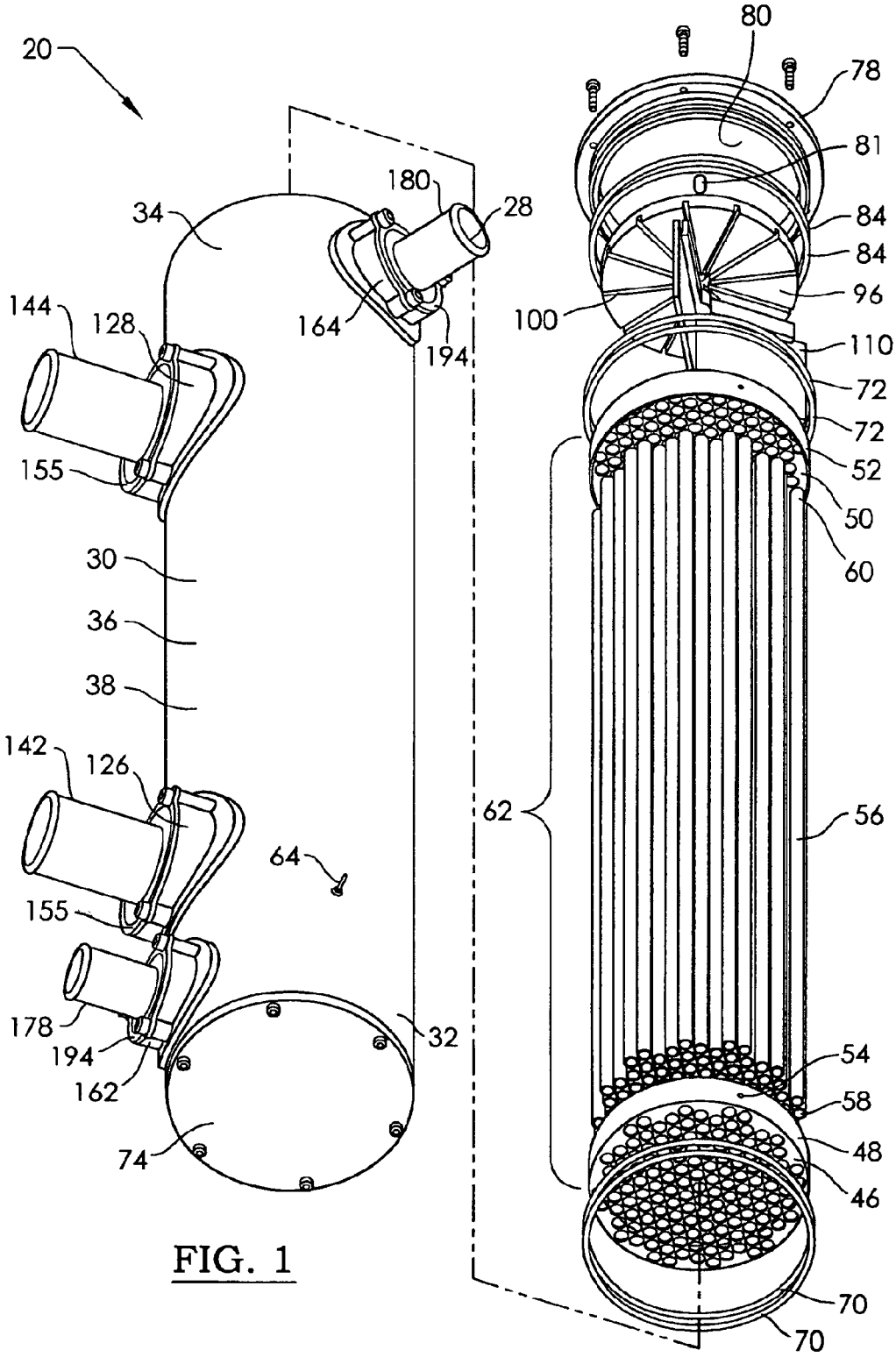
FIG. 1 is a partially exploded, perspective, assembly view of a heat exchanger constructed in accordance with the invention, and showing a resilient disc and a separator.

Referring now to the drawing, and especially to FIGS. 1, 2, 4, 5, and 6 thereof, a shell and tube heat exchanger constructed in accordance with the invention is shown at 20. The heat exchanger is used for transferring heat between a shell coolant flowing around the outside of the tubes, and a tube coolant flowing inside the tubes. The heat exchanger is for use particularly with a marine engine. The coolants will be carried by external conduits between the engine and the heat exchanger. The shell coolant will typically be a glycol-based engine coolant. The tube coolant will typically be seawater. It is to be understood that the tube coolant can be the engine coolant, and the shell coolant can be the seawater. It is also to be understood that the heat exchanger can be used for a variety of applications, such as a stationary engine, or a process plant. Further, the coolants can be any heat exchanging fluid medium. The heat exchanger 20 has first 22 and second 24 shell coolant passageways, and first 26 and second 28 tube coolant passageways, to conduct the coolants. The heat exchanger 20 comprises a shell 30, having a central axis. The shell 30 extends between opposite first 32 and second 34 ends, and has a wall 36 extending around a periphery 38 with an inner surface 39, and defining a shell cavity 40 therein. The first shell coolant passageway 22 passes through the shell wall 36 adjacent the shell first end 32. The second shell coolant passageway 24 passes through the shell wall 36 adjacent the shell second end 34. The shell 30 has at least one threaded locating hole 42 through the side wall 36. The shell 30 has a plurality of grooves 44 within the shell cavity 40, the grooves 44 being aligned with the central axis. The shell 30 is constructed from a non-metallic corrosion resistant material such as a thermoplastic or thermoset resin, preferably polyvinylchloride (PVC). In the preferred embodiment, the shell 30 is extruded, cut to length, and the details are then machined to specification.

The heat exchanger 20 includes a first tube header 46 with an outer periphery 48, and a second tube header 50 with an outer periphery 52. The first 46 and second 50 headers are spaced apart and generally parallel. The headers 46 and 50 have a plurality of holes 51 drilled or punched through, and arranged in a pattern. At least one header periphery 48 and 52 has a locating recess 54, usually a radially stamped or drilled hole or dimple.

A plurality of generally straight and parallel tubes 56 extend between the first 46 and second 50 headers. The tubes 56 have a first 58 and second 60 open ends attached to and penetrating the first 46 and second 50 headers, respectively, through the holes 51. The holes 51 and tubes 56 are arranged in a predetermined pattern having adjacent straight rows of tubes. The first tube header 46, the second tube header 50, and the tubes 56 comprise a tube bundle 62. The tube bundle 62 will typically be fabricated from metal materials having efficient heat transferring and corrosion resisting properties, preferably copper or a copper alloy. The tubes 56 are soldered or silver-soldered or brazed into the holes 51 in the headers 46 and 50. The tube bundle 62 is removably received within the shell cavity 40 with the first header 46 adjacent the shell first end 32, and the second header 50 adjacent the shell second end 34. The header locating recess 54 is juxtaposed with the threaded locating hole 42. Installation of the tube bundle 62 in the shell 30 and removal therefrom is easily accomplished by sliding the tube bundle 62 into either end of the shell 30.

Figure 14:
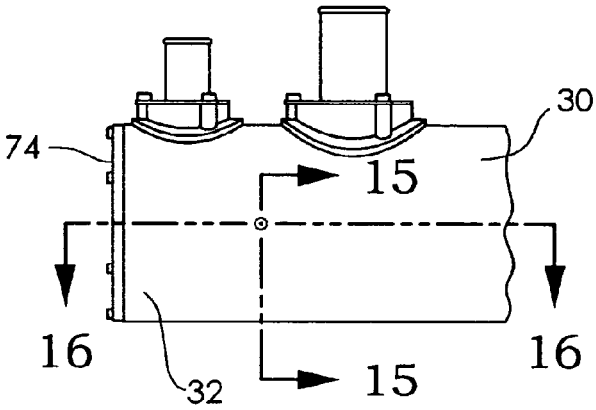
FIG. 14 is a right side partial elevational view of the heat exchanger of FIG. 1.
Figure 15:
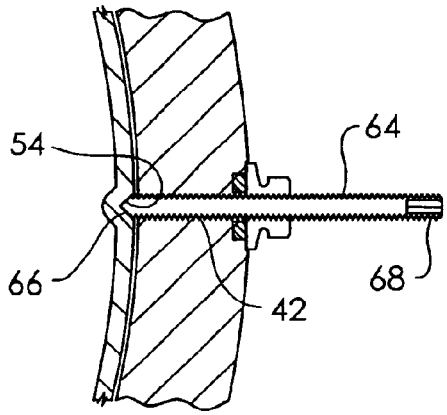
FIG. 15 is a partial front end sectional elevational view of the heat exchanger of FIG. 14, taken along lines 15—15 of FIG. 14.
Figure 16:
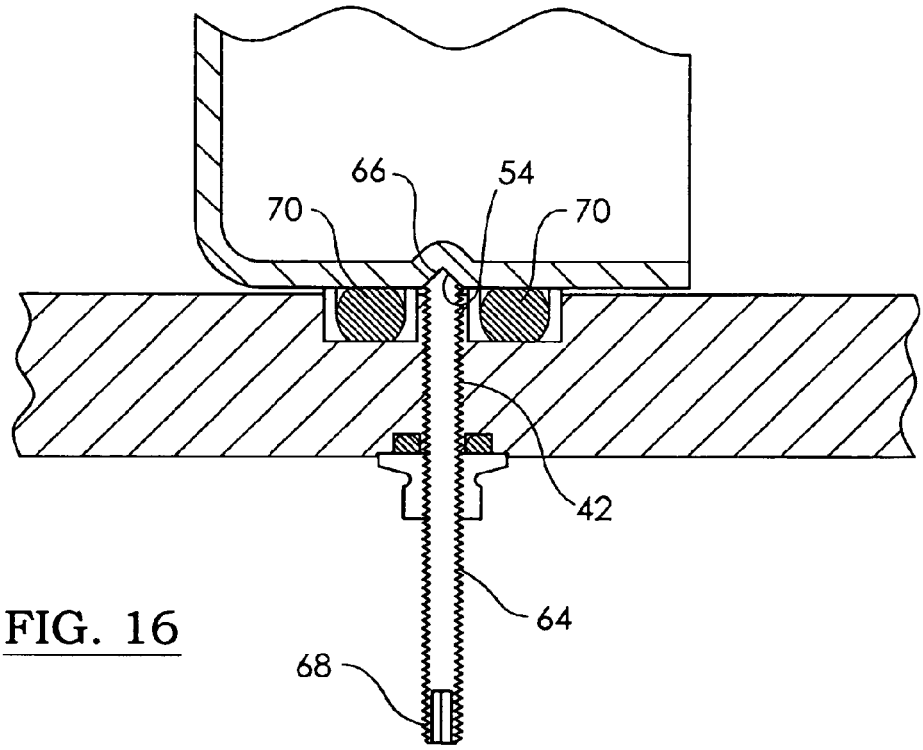
FIG. 16 is a partial top sectional view of the heat exchanger of FIG. 14, taken along lines 16—16 of FIG. 14.

Turning now to FIGS. 14, 15, and 16, as well as 1, 2, 4, 5, and 6, a locating screw 64 is provided, and extends between opposite proximal 66 and distal 68 ends. The locating screw 64 threadably engages the threaded locating hole 42. The locating screw proximal end 66 is typically formed into a cone, and engages the locating recess 54. The locating screw 64 is used to locate the tube bundle 62 angularly about the central axis and longitudinally along the central axis in a predetermined alignment with the shell. The locating screw 64 is also used to electrically ground the tube bundle 62 to an external ground (not shown) by connection with a wire (not shown).

At least one first header O-ring 70, and preferably two O-rings 70, are sealingly juxtaposed between a first header periphery 48 and the shell 30 for slidably sealing the first header 46 to the shell 30. Similarly, at least one second header O-ring 72, and preferably two O-rings 72, are sealingly juxtaposed between the second header periphery 52 and the shell 30 for slideably sealing the second header 50 to the shell 30. A pair of annular grooves 74 is provided for the O-rings 70 and 72 in the inner surface 39 of the shell 30 near each end 32 and 34. Thus, the tube bundle 62 can be installed and removed from either end of the shell 30. The sealing is redundant, with two O-rings 70 and 72 at each header 46 and 50 respectively, to reduce the likelihood of leakage. A further novel aspect is that the locating screw 64 can be removed to determine leakage. If glycol leaks out, the inner O-ring is leaking, and if seawater leaks out, the outer O-ring is leaking. A second screw (not shown) can be installed adjacent the opposite header, for sealing. The second screw will not seat into a locating recess, so that the tube bundle 62 will be fixed at one header, and allowed to expand thermally at the opposite header.

A first end cover 74, having an inside surface 76, and a pin 77, is removably attached to the shell first end 32. A second end cover 78, having an inside surface 80, and a pin 81, is removably attached to the shell second end 34. At least one first end cover O-ring 82, and preferably two O-rings 82, are sealingly juxtaposed between the first end cover 74 and the shell 30, for sealing the first cover 74 to the shell 30. At least one second end cover O-ring 84, and preferably two O-rings 84, are sealingly juxtaposed between the second end cover 78 and the shell 30 for sealing the second end cover 78 to the shell 30.

The shell cavity 40 includes a first chamber 86 extending between the first tube header 46 and the first end cover 74. The shell cavity 40 also includes a second chamber 88 extending between the second tube header 50 and the second end cover 78. The first 26 and second 28 tube coolant passageways are in communication with the first 86 and second 88 chambers respectively. The tube first 58 and second 60 open ends are in communication with the first 86 and second 88 chambers respectively, so as to allow passage of the tube coolant between the first 86 and second 88 chambers through the tubes 56.

Figure 12:
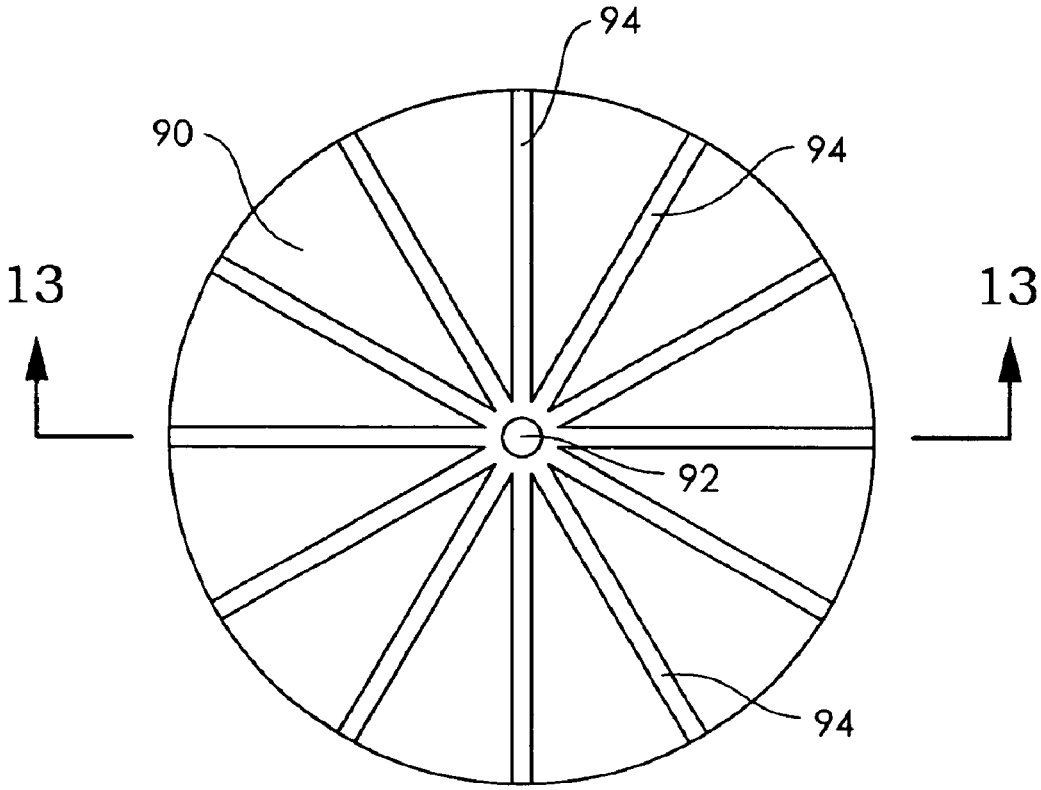
FIG. 12 is a top view of the resilient disc of FIG. 11.
Figure 11:
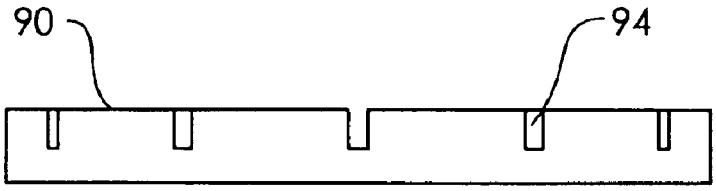
FIG. 11 is a front elevational view of the resilient disc shown in FIG. 1.
Figure 13:
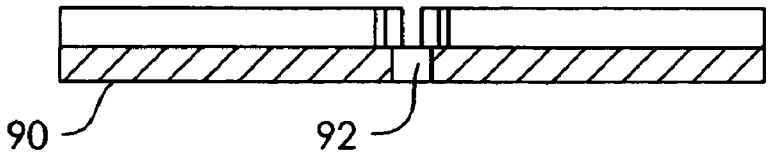
FIG. 13 is a front sectional elevational view of the resilient disc of FIG. 11, taken along lines 13—13 of FIG. 12.

Referring now to FIGS. 11, 12, and 13, as well as 1, 2, 4, 5, 6, 14, 15, and 16, a first resilient disc 90 is disposed against the first end cover inside surface 76. The first resilient disc 90 has a center hole 92 through it, aligned with the central axis. A plurality of channels 94 extends radially outward from the center hole 92. A second resilient disc 96 is disposed against the second end cover inside surface 80. The second resilient disc 96 has a center hole 98 through it, aligned with the central axis. A plurality of channels 100 extends radially outward from the center hole 98. The first 90 and second 96 resilient discs are molded from a heat resistant elastomeric material, preferably silicone. The hardness durometer will be selected by one skilled in the art to provide sealing properties while maintaining net shape.

Referring now to FIGS. 7, 8, 9, and 10, as well as 1, 2, 4, 5, 6, 11, 12, 13, 14, 15, and 16, a first flow separator 102 is removably received within the first chamber 86. The first flow separator 102 has a plurality of plates 104 which extend radially from unitary proximal ends 106 adjacent the central axis outward to distal ends 108 adjacent the shell 30. The plates' distal ends 108 are received in the shell grooves 44. The plates 104 extend axially from the first header 46 to the first resilient disc 90 wherein the plates 104 are sealingly received in the channels 94. The first flow separator plates 104 further comprise an outer portion 105 aligned with the central axis so as to be received in the channels 94, and an inner portion 107 integral and in stepped relation with the outer portion 105 transverse to the direction of the central axis. The inner portion 107 is disposed between the adjacent straight rows of tubes so as to not obstruct tube coolant flow.

A second flow separator 110 is removably received within the second chamber 88. The second flow separator 110 has a plurality of plates 112 which extend radially from unitary proximal ends 114 adjacent the central axis outward to distal ends 116 adjacent the shell 30. The plates' distal ends 116 are received in the shell grooves 44. The plates 112 extend axially from the second header 50 to the second resilient disc 96 wherein the plates 112 are sealingly received in the channels 100. The second flow separator plates 112 further comprises an outer portion 113 aligned with the central axis so as to be received in the channels 100 and an inner portion 115 integral and in stepped relation with the outer portion 113 transverse to the direction of the central axis. The inner portion 115 is disposed between the adjacent straight rows of the tubes so as to not obstruct tube coolant flow.

An inner pin and socket locating means is provided for locating and attaching the first 102 and second 110 flow separators to the first 46 and second 50 tube headers, respectively. Specifically, pins 118 and 120 are attached to the first 102 and second 110 flow separators respectively, on the central axis. The pins 118 and 120 engage the opposite open ends of one tube 56, which is located on the central axis. An outer pin and socket locating means is provided for locating and attaching the first 102 and second 110 flow separators to the first 74 and second 78 end covers, respectively. Specifically, sockets 122 and 124 are attached to the first 102 and second 110 flow separators respectively, on the central axis. The sockets 122 and 124 engage the first 77 and second 81 end cover pins, respectively. The outer pin and socket locating means penetrates the first 92 and second 98 resilient disc holes.

Figure 2:
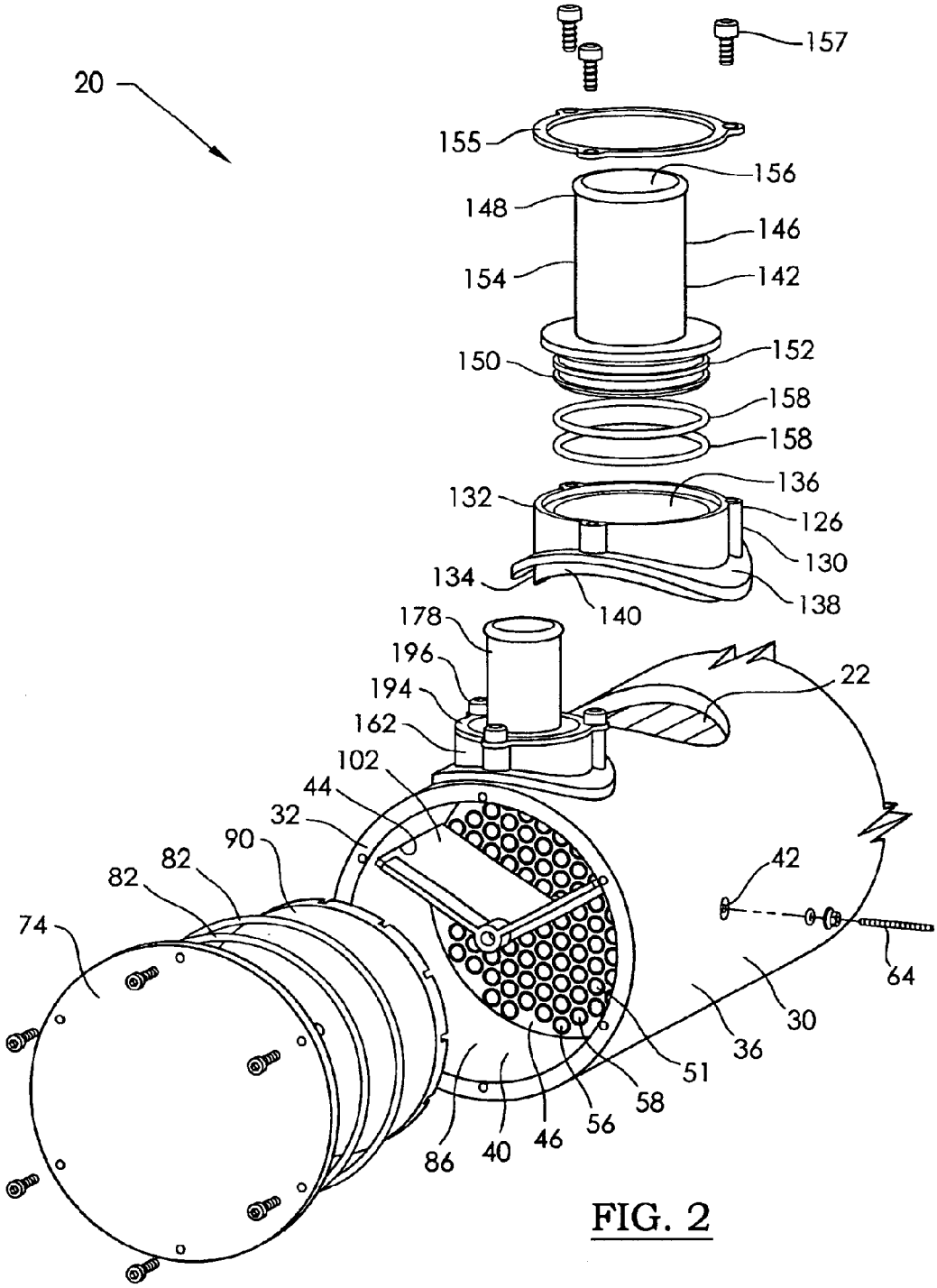
FIG. 2 is a partially exploded perspective view of one end of the heat exchanger of FIG. 1.
Figure 3:
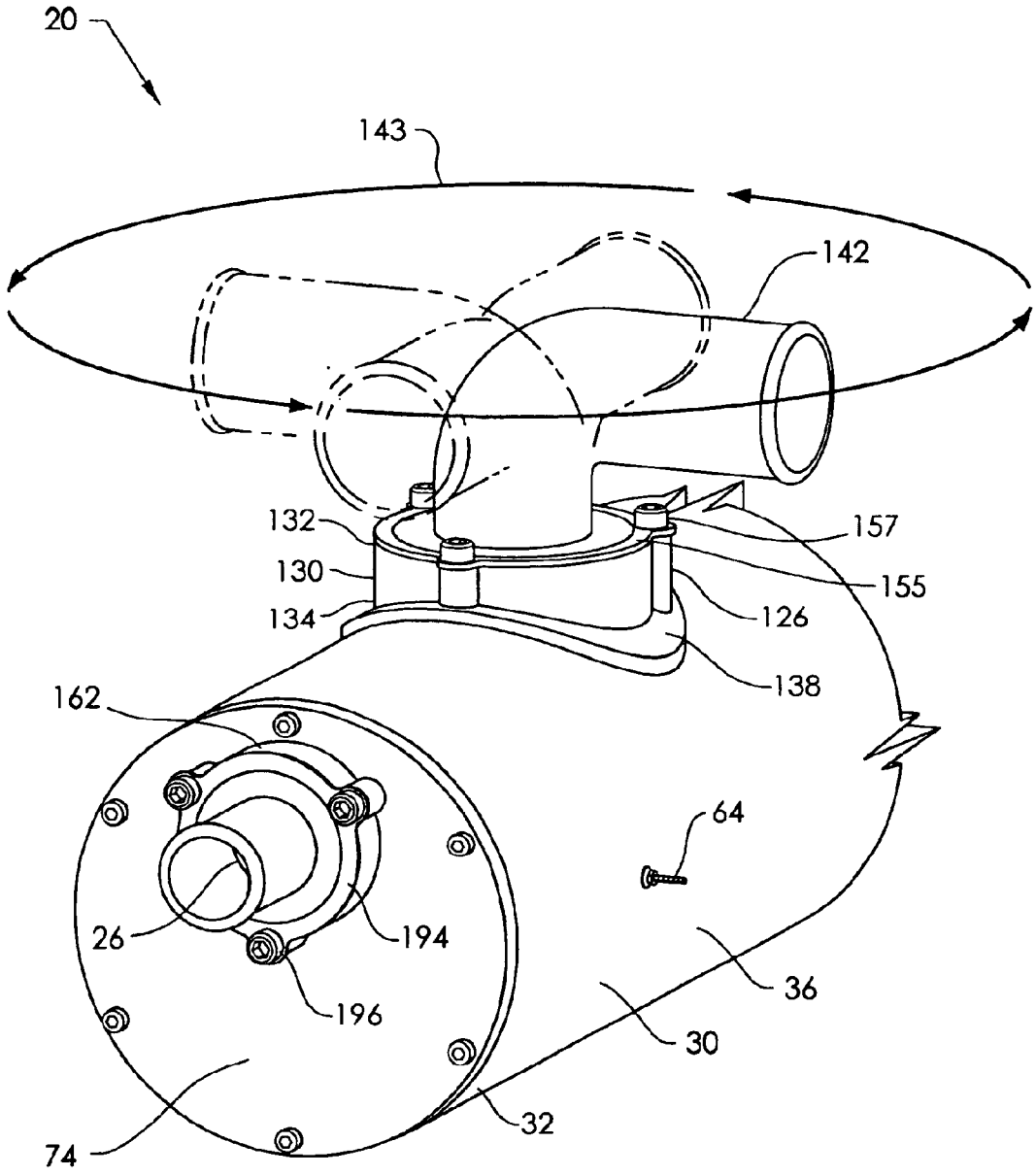
FIG. 3 is a perspective view of the heat exchanger of FIG. 1.
Figure 4:
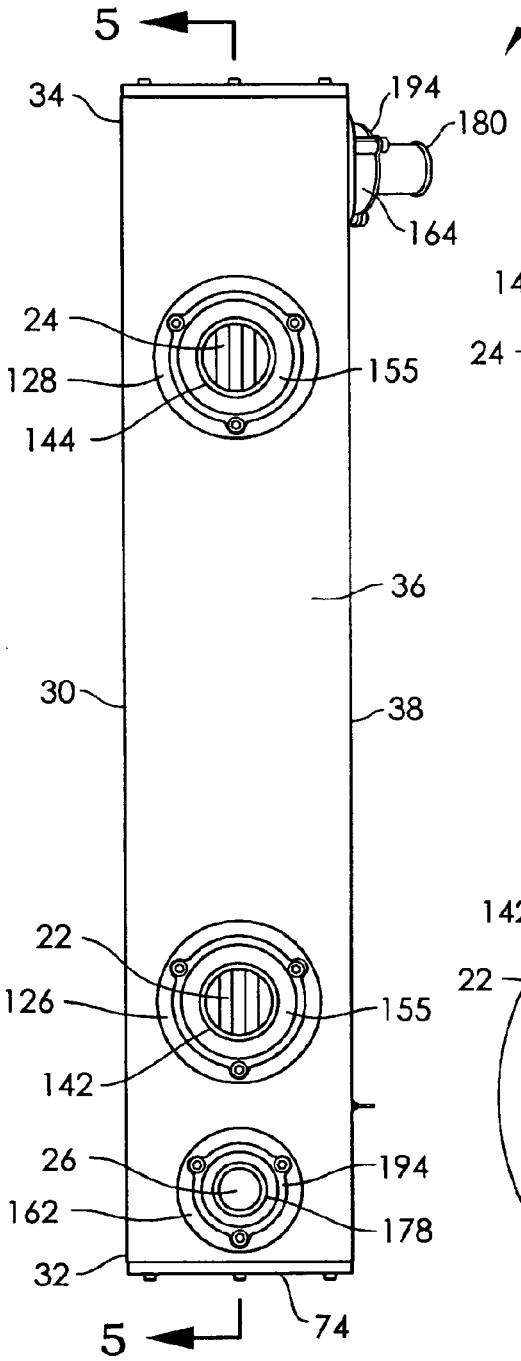
FIG. 4 is a top view of the heat exchanger of FIG. 1.
Figure 5:
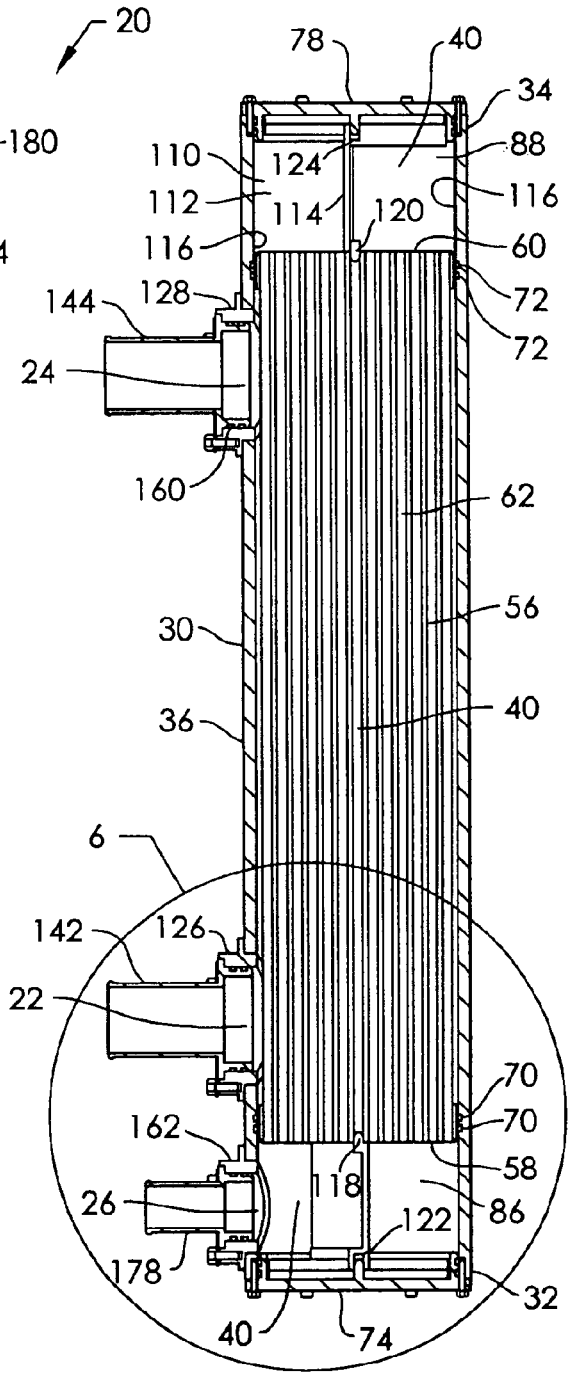
FIG. 5 is a right side sectional elevational view of the heat exchanger of FIG. 1, taken along lines 5—5 of FIG. 4.
Figure 6:
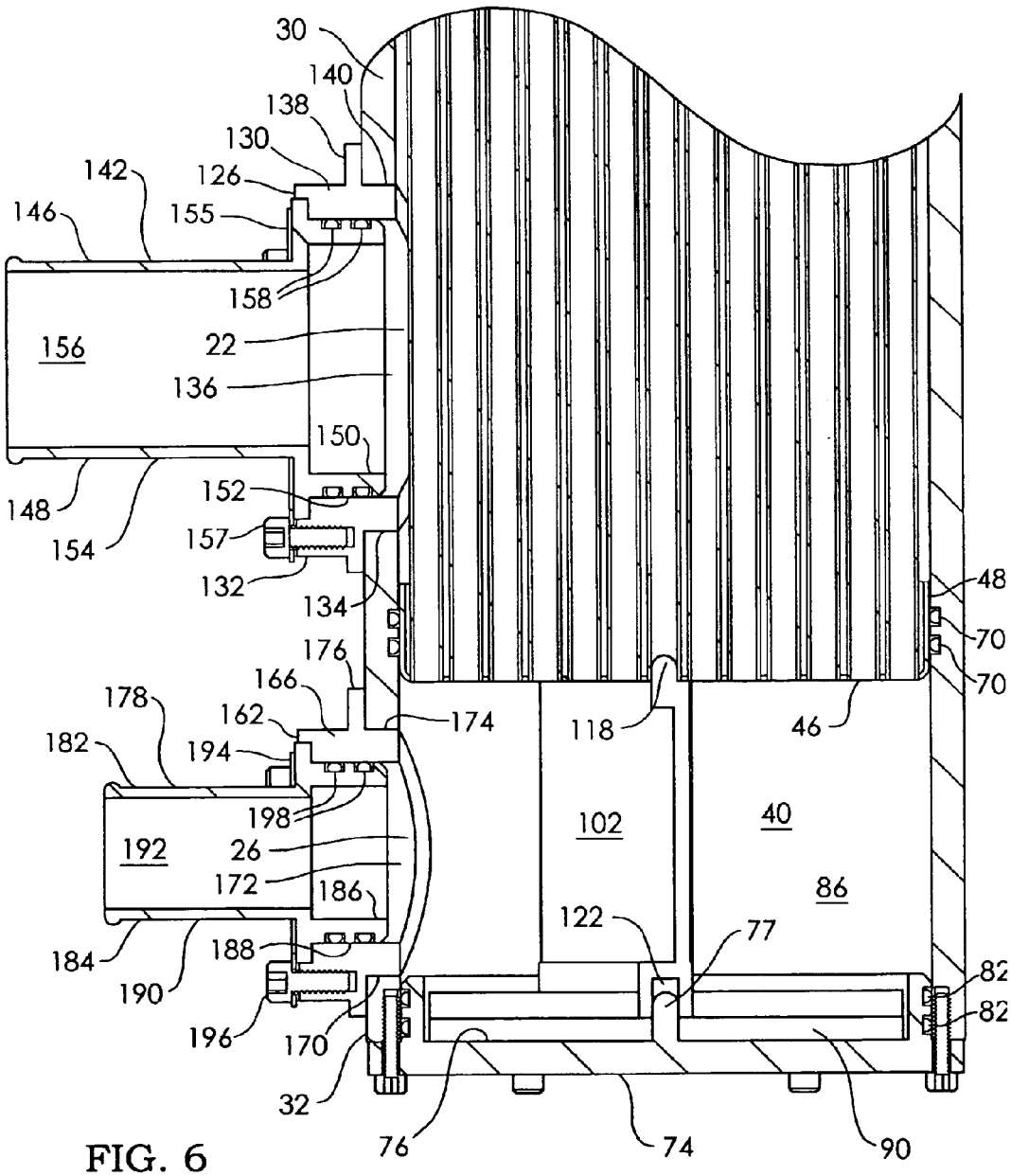
FIG. 6 is an enlarged sectional detail view of the heat exchanger of FIG. 1, taken at circle 6 of FIG. 5.
Figure 10:
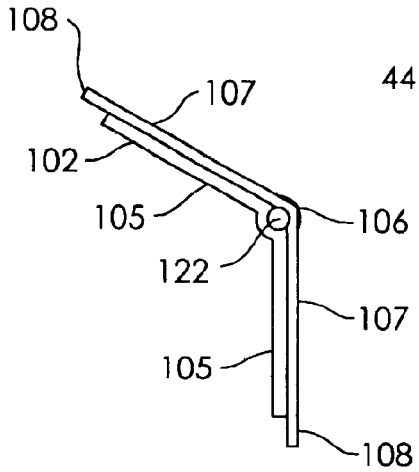
FIG. 10 is a top view of the separator of FIG. 7.
Figure 7:
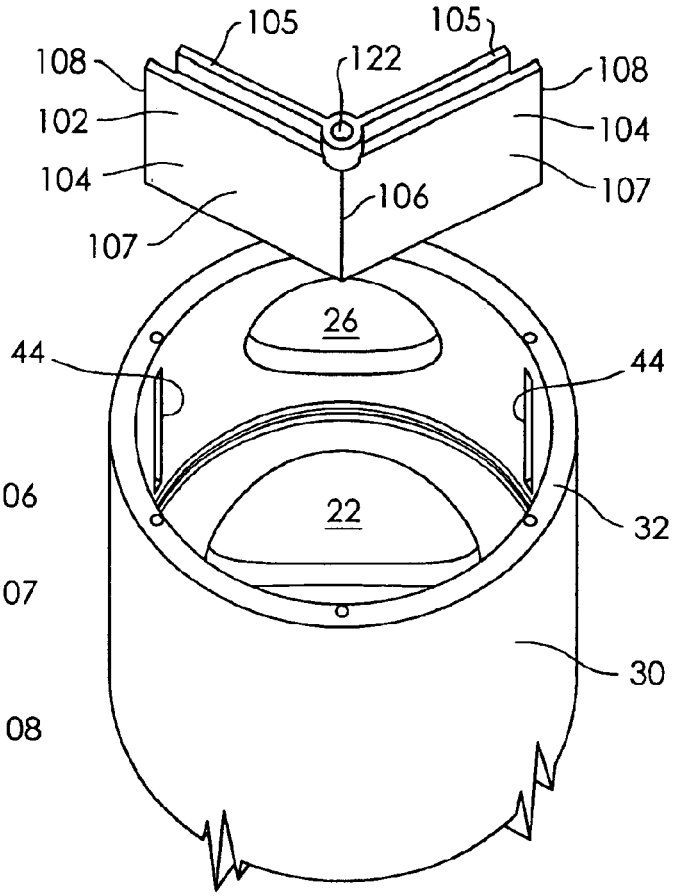
FIG. 7 is a partial perspective view of the shell of the heat exchanger of FIG. 1, and showing the separator.
Figure 8:
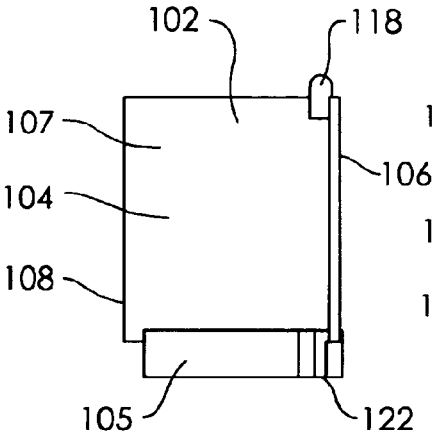
FIG. 8 is a front elevational view of the apparatus of FIG. 7.
Figure 9:
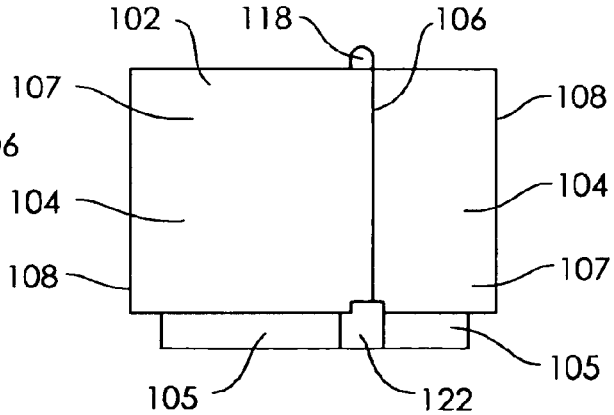
FIG. 9 is a right side elevational view of the separator of FIG. 7.

Turning now to FIG. 3, as well as 1, 2, 4, 5, and 6, a first shell coolant receiver 126 and a second shell coolant receiver 128, are juxtaposed with the first 22 and second 24 shell coolant passageways, respectively. Each shell coolant receiver 126 and 128 has a central axis, and a body 130 extending between upper 132 and lower 134 ends. A circular bore 136 passes through the body 130 and is in communication with the shell cavity 40. A saddle-shaped flange 138 encircles the body 130, as seen in FIG. 2. The flange 138 has a radius that closely conforms to the radius of the shell 30. The body lower end 134 has a pilot 140 that penetrates the shell 30 at the shell coolant passageway 22 and 24. The flange 138 and body 130 are bonded to the shell 30.

A first shell coolant connector 142 and a second shell coolant connector 144 are provided, each shell coolant connector 142 and 144 having a central axis and a body 146 extending between upper 148 and lower 150 ends. The body lower end 150 has a pilot 152, and the body upper end 148 has a nozzle 154. The nozzles 154 has an axis at an angle to the connector central axis of between zero and ninety degrees. The first shell coolant connector pilot 152 is removably and rotatably received within the first shell coolant receiver bore 136. The second shell coolant connector pilot 152 is removably and rotatably received within the second shell coolant receiver bore 136. Each shell coolant connector 142 and 144 has a circular bore 156 passing through the body 146 and in communication with the respective shell coolant receiver bore 136. Retaining means is provided for retaining the connector pilot 152 in the receiver body 136, while allowing selective rotation of the connector 142 and 144 about the connector central axis, as shown by arrow 143 in FIG. 3. Specifically, the retaining means includes a retaining ring 155 encircling the connector 142 and 144 and attached to the receiver 126 and 128 respectively, with screws 157.

At least one first shell coolant connector O-ring 158, and preferably two O-rings 158, are sealingly juxtaposed between the first shell coolant connector pilot 152 and the first shell coolant receiver bore 136. This allows for rotatably sealing the first shell coolant connector 142 to the first shell coolant receiver 126. At least one second shell coolant connector O-ring 160, and preferably two O-rings 160, are sealingly juxtaposed between the second shell connector pilot 152 and the second shell coolant receiver bore 136. This allows for rotatably sealing the second shell coolant connector 144 to the second shell coolant receiver 128.

A first tube coolant receiver 162 and a second tube coolant receiver 164 are juxtaposed with the first 26 and second 28 tube coolant passageways respectively. Each tube coolant receiver 162 and 164 has a central axis and a body 166 extending between upper 168 and lower 170 ends. The first 162 and second 164 tube coolant receivers each have a circular bore 172 passing through the body 166 and in communication with the first 86 and second 88 chambers respectively. In a first embodiment, the body lower end 170 of the first tube coolant receiver 162 has a pilot 174 penetrating the shell 30 and the first chamber 86. A flange 176 encircles the body 166. The flange 176 and the pilot 174 are bonded to the shell 30. In a second embodiment similar to the first, the body lower end 170 of the second tube coolant receiver 164 has a pilot 174 penetrating the second chamber 88. A flange 176 encircles the body 166. The flange 176 and the pilot 174 are bonded to the shell 30. In a third embodiment, shown in FIG. 3, the first tube coolant receiver 162 is integral with the first end cover 74. In a fourth embodiment, not shown but similar to FIG. 3, the second tube coolant receiver 164 is integral with the second end cover 78.

A first tube coolant connector 178 and a second tube coolant connector 180 are provided, each tube coolant connector 178 and 180 having a central axis and a body 182 extending between upper 184 and lower 186 ends. The body lower end 186 has a pilot 188, and the body upper end 184 has a nozzle 190. The nozzle 190 has an axis at an angle to the connector central axis of between zero and ninety degrees. The first tube coolant connector pilot 188 is removably and rotatably received within the first tube coolant receiver bore 172. The second tube coolant connector pilot 188 is removably and rotatably received within the second tube coolant receiver bore 172. Each tube coolant connector 178 and 180 has a circular bore 192 passing through the body 182 and in communication with the respective tube coolant receiver bore 172. Retaining means is provided for retaining the connector pilot 188 in the receiver bore 172, while allowing selective rotation of the connector 178 and 180 about the connector central axis. This ability to rotate, and then be clamped in any angular position, is similar to that of the shell coolant connector described above, and shown by arrow 143 in FIG. 3. Specifically, the retaining means includes a retaining ring 194 encircling the connector 178 and 180 and attached to the receiver 162 and 164 respectively, with screws 196.

At least one first tube coolant connector O-ring 198, and preferably two O-rings 198, are sealingly juxtaposed between the first tube coolant connector pilot 188 and the first tube coolant receiver bore 172. This allows for rotatably sealing the first tube coolant connector 178 to the first tube coolant receiver 162. Likewise, at least one second tube coolant connector O-ring 198, and preferably two O-rings 198, are sealingly juxtaposed between the second tube coolant connector pilot 188 and the second tube coolant receiver bore 162. This allows for rotatably sealing the second tube coolant connector 180 to the second tube coolant receiver 164.

As with the shell 30, the end covers 74 and 78; flow separators 102 and 110; coolant receivers 126, 128, 162, 164; and coolant connectors 142, 144, 178, and 180; are constructed from a non-metallic corrosion resistant material such as a thermoplastic or thermoset resin, preferably polyvinylchloride (PVC). Unlike the shell, these parts will typically be molded to net shape. The retaining rings 155 and 194; and the locating screw 64; as well as other fasteners, are made from a corrosion resistant metal such as stainless steel or brass.

The ability to mold the shell coolant connector nozzles 154 and the tube coolant connector nozzles 190 to any elevation from 0 to 90 degrees, and rotate them on axis 360 degrees to any position, allows connection of the nozzles 154 and 190 to the external conduits (not shown) in any orientation. Thus, the heat exchanger 20 can be mounted in any position within the vessel, and the external coolant conducting conduits can be conveniently routed from any direction for installation.

Numerous modifications and alternative embodiments of the invention will be apparent to those skilled in the art in view of the foregoing description. Accordingly, this description is to be constructed as illustrative only and is for the purpose of teaching those skilled in the art the best mode of carrying out the invention. Details of the structure may be varied substantially without departing from the spirit of the invention and the exclusive use of all modifications that will come within the scope of the appended claims is reserved.

What is claimed is:

1. A shell and tube heat exchanger for transferring heat between a shell coolant and a tube coolant, the coolants being carried by external conduits, the heat exchanger having first and second shell coolant passageways and first and second tube coolant passageways to conduct the coolants, the heat exchanger comprising:

a shell, the shell having a central axis, the shell extending between opposite first and second ends, the shell having a wall extending around a periphery and defining a shell cavity therein, the first shell coolant passageway passing through the shell wall adjacent the shell first end, the second shell coolant passageway passing through the shell wall adjacent the shell second end, the shell having at least one threaded locating hole through the shell wall;

a first tube header having an outer periphery, and a second tube header having an outer periphery, the first and second tube headers being spaced apart and generally parallel, at least one tube header periphery having a locating recess;

a plurality of generally straight and parallel tubes extending between the first and second tube headers, the tubes having first and second open ends attached to and penetrating the first and second tube headers, respectively;

wherein the first tube header, the second tube header, and the tubes comprise a tube bundle, the tube bundle being removably received within the shell cavity with the first tube header adjacent the shell first end, and the second tube header adjacent the shell second end, the tube header locating recess being juxtaposed with the threaded locating hole;

a locating screw extending between opposite proximal and distal ends, the locating screw threadably engaging the threaded locating hole, the locating screw proximal end engaging the locating recess, the locating screw being adapted to locate the tube bundle angularly about the shell central axis and longitudinally along the shell central axis in a predetermined alignment wit the shell;

a first end cover removably attached to the shell first end, the first end cover having an inside surface, and a second end cover removably attached to the shell second end, the second end cover having an inside surface;

wherein the shell cavity includes a first chamber extending between the first tube header and the first end cover, and the shell cavity includes a second chamber extending between the second tube header and the second end cover, the first and second tube coolant passageways being in communication with the first and second chambers respectively, and the tube first and second open ends being in communication with the first and second chambers respectively, so as to allow passage of the tube coolant between the first and second chambers through the tubes;

first tube header sealing means for slidably sealing the first tube header to the shell;

second tube header sealing means for slidably sealing the second tube header to the shell;

first end cover sealing means for sealing the first end cover to the shell;

second end cover sealing means for sealing the second end cover to the shell;

wherein the shell is constructed of a non-metallic corrosion resistant material; and wherein the first and second tube headers and tubes are constructed of metal materials having efficient heat transfer properties.

2. The heat exchanger of claim 1, wherein the locating screw is adapted to electrically ground the tube bundle to an external ground.

3. The heat exchanger of claim 1, wherein:

the first tube header sealing means includes at least one first header O-ring sealingly juxtaposed between the first tube header periphery and the shell;

the second tube header sealing means includes at least one second header O-ring sealingly juxtaposed between the second tube header periphery and the shell;

the first end cover sealing means includes at least one first end cover O-ring sealingly juxtaposed between the first end cover and the shell; and the second end cover sealing means includes at least one second end cover O-ring sealingly juxtaposed between the second end cover and the shell.

4. The heat exchanger of claim 1, further comprising:

a first resilient disc disposed against the first end cover inside surface, the first resilient disc having a plurality of channels extending radially outward;

a second resilient disc disposed against the second end cover inside surface, the second resilient disc having a plurality of channels extending radially outward;

a first flow separator removably received within the first chamber, the first flow separator having a plurality of plates, the plates extending radially from unitary proximal ends adjacent the shell central axis outward to distal ends adjacent the shell, wherein the shell includes a plurality of grooves aligned with the shell central axis, the plates distal ends being received in the grooves, the plates extending axially from the first tube header to the first resilient disc wherein the plates are sealingly received in the channels; and a second flow separator removably received within the second chamber, the second flow separator having a plurality of plates, the plates extending radially from unitary proximal ends adjacent the shell central axis outward to distal ends adjacent the shell, wherein the shell includes a plurality of grooves aligned with the shell central axis, the plates distal ends being received in the grooves, the plates extending axially from the second tube header to the second resilient disc wherein the plates are sealingly received in the channels.

5. The heat exchanger of claim 4, further comprising:

an inner pin and socket locating means for locating and attaching the first and second flow separators to the first and second tube headers, respectively;

an outer pin and socket locating means for locating and attaching the first and second flow separators to the first and second end covers, respectively; and wherein the first and second resilient disc each includes a hole therethrough juxtaposed with the outer pin and socket locating means.

6. The heat exchanger of claim 5, wherein the tubes are arranged in a predetermined pattern having adjacent straight rows of tubes and the first and second flow separator plates further comprise:

an outer portion aligned with the shell central axis so as to be received in the channels; and an inner portion integral and in stepped relation with the outer portion transverse to the direction of the shell central axis, the inner portion being disposed between the adjacent straight rows of tubes so as to not obstruct tube coolant flow.

7. The heat exchanger of claim 1, further comprising:

a first shell coolant receiver and a second shell coolant receiver, the first and second shell coolant receivers being juxtaposed with the first and second shell coolant passageways respectively, each shell coolant receiver having a central axis, a body extending between upper and lower ends, a circular bore passing through the body and in communication with the shell cavity, a saddle-shaped flange encircling the body, the flange closely conforming to the shell, the body lower end having a pilot penetrating the shell, the flange and body being bounded to the shell;

a first shell coolant connector and a second shell coolant connector, each shell coolant connector having a central axis and a body extending between upper and lower ends, the body lower end having a pilot, the body upper end having a nozzle, the nozzle having an axis at an angle to the connector central axis of between zero and ninety degrees, the first shell coolant connector pilot being removably and rotatably received within the first shell connector receiver bore, and the second shell coolant connector pilot being removably and rotatably received within the second shell coolant receiver bore, each shell coolant connector having a circular bore passing through the body and in communication with the respective shell coolant receiver bore;

first shell coolant connector sealing means for rotatably sealing the first shell coolant connector to the first shell coolant receiver;

second shell coolant connector sealing means for rotatably sealing the second shell coolant connector to the second shell coolant receiver;

a first tube coolant receiver and a second tube coolant receiver, the first and second tube coolant receivers being juxtaposed with the first and second tube coolant passageways respectively, each tube coolant receiver having a central axis and a body extending between upper and lower ends, the first and second tube coolant receivers each extending between upper and lower ends, a circular bore passing through the body and in communication with the shell cavity, a saddle-shaped flange encircling the body, the flange closely conforming to the shell, the body lower end having a pilot penetrating the shell, the flange and body being bonded to the shell;

a first shell coolant connector and a second shell coolant connector, each shell coolant connector having a central axis and a body extending between upper and lower ends, the body lower end having a pilot, the body upper end having a nozzle, the nozzle having an axis at an angle to the connector central axis of between zero and ninety degrees, the first shell coolant connector pilot being removably and rotatably received within the first shell connector receiver bore, and the second shell coolant connector pilot being removably and rotatably received within the second shell coolant receiver bore, each shell coolant connector having a circular bore passing through the body and in communication with the respective shell coolant receiver bore;

first shell coolant connector sealing means for rotatably sealing the first shell coolant connector to the first shell coolant receiver;

second shell coolant connector sealing means for rotatably sealing the second shell coolant connector to the second shell coolant receiver;

a first tube coolant receiver and a second tube coolant receiver, the first and second tube coolant receivers being juxtaposed with the first and second tube coolant passageways respectively, each tube coolant receiver having a central axis and a body extending between upper and lower ends, the first and second tube coolant receivers each having a circular a bore passing through the body and in communication with the first and second chambers respectively;

a first tube coolant connector and a second tube coolant connector, each tube coolant connector having a central axis and a body extending between upper and lower ends, the body lower end having a pilot, the body upper end having a nozzle, the nozzle having an axis at an angle to the connector central axis of between zero and ninety degrees, the first tube coolant connector pilot being removably and rotatably received within the first tube coolant receiver bore, and the second tube coolant connector pilot being removably and rotatably received within the second tube coolant receiver bore, each tube coolant connector having a circular bore passing through the body and in communication with the respective tube coolant receiver bore;

first tube coolant connector sealing means for rotatably sealing the first tube coolant connector to the first tube coolant receiver;

second tube coolant connector sealing means for rotatably sealing the second tube coolant connector to the second tube coolant receiver, so as to allow connection of the nozzles to the external conduits in any orientation; and retaining means for retaining the connector pilot in the receiver bore, while allowing selective rotation of the connector about the connector central axis.

8. The heat exchanger of claim 7, wherein:

the first tube coolant receiver has a flange encircling the body;

the body lower end has a pilot penetrating the shell and the first chamber; and the first tube coolant receiver flange and pilot are bonded to the shell.

9. The heat exchanger of claim 7, wherein:

the second tube coolant receiver has a flange encircling the body;

the body lower end has a pilot penetrating the shell and the second chamber; and the second tube coolant receiver flange and pilot are bonded to the shell.

10. The heat exchanger of claim 7, wherein the first tube coolant receiver is integral with the first end cover.

11. The heat exchanger of claim 7, wherein the second tube coolant receiver is integral with the second end cover.

12. The heat exchanger of claim 7, wherein:

the first shell coolant connector sealing means includes at least one first shell coolant connector O-ring sealingly juxtaposed between the first shell coolant connector pilot and the first shell coolant receiver bore;

the second shell coolant connector sealing means includes at least one second shell coolant connector O-ring sealingly juxtaposed between the second shell coolant connector pilot and the second shell coolant receiver bore;

the first tube coolant connector sealing means includes at least one first tube coolant connector O-ring sealingly juxtaposed between the first tube coolant connector pilot and the first tube coolant receiver bore; and the second tube coolant connector sealing means includes at least one second tube coolant connector O-ring sealingly juxtaposed between the second tube coolant connector pilot and the second tube coolant receiver bore.

13. A shell and tube heat exchanger for transferring heat between a shell coolant and a tube coolant, the coolants being carried by external conduits, the heat exchanger having first and second shell coolant passageways and first and second tube coolant passageways to conduct the coolants, the heat exchanger comprising:

a shell, the shell having a central axis, the shell extending between opposite first and second ends, the shell having a wall extending around a periphery and defining a shell cavity therein, the first shell coolant passageway passing through the shell wall adjacent the shell first end, the second shell coolant passageway passing through the shell wall adjacent the shell second end, the shell having a plurality of grooves within the shell cavity, the grooves being aligned with the shell central axis;

a first tube header having an outer periphery, and a second tube header having an outer periphery, the first and second tube headers being spaced apart and generally parallel;

a plurality of generally straight and parallel tubes extending between the first and second tube headers, the tubes having first and second open ends attached to and penetrating the first and second tube headers, respectively;

wherein the first tube header, the second tube header, and the tube comprise a tube bundle, the tube bundle being removably received within the shell cavity with the first tube header adjacent the shell first end, and the second tube header adjacent the shell second end;

a first end cover removably attached to the shell first end, the first end cover having an inside surface, and a second end cover removably attached to the shell second end, the second end cover having an inside surface;

wherein the shell cavity includes a first chamber extending between the first tube header and the first end cover, and the shell cavity includes a second chamber extending between the second tube header and the second end cover, the first and second tube coolant passageways being in communication with the first and second chambers respectively, and the tube first and second open ends being in communication with the first and second chambers respectively, so as to allow passage of the tube coolant between the first and second chambers through the tubes;

first tube header sealing means for slideably sealing the first tube header to the shell;

second tube header sealing means for slidably sealing the second tube header to the shell;

first end cover sealing means for sealing the first end cover to the shell;

second end cover sealing means for sealing the second end cover to the shell;

a first resilient disc disposed against the first end cover inside surface, the first resilient disc having a plurality of channels extending radially outward;

a second resilient disc disposed against the second end cover inside surface, the second resilient disc having a plurality of channels extending radially outward;

a first flow separator removably received within the first chamber, the first flow separator having a plurality of plates, the plates extending radially from unitary proximal ends adjacent the shell central axis outward to distal ends adjacent the shell, the plates distal ends being received in the shell grooves, the plates extending axially from the first tube header to the first resilient disc wherein the plates are sealingly received in the channels;

a second flow separator removably received within the second chamber, the second flow separator having a plurality of plates, the plates extending radially from unitary proximal ends adjacent the shell central axis outward to distal ends adjacent the shell, the plates distal ends being received in the shell grooves, the plates extending axially from the second tube header to the second resilient disc wherein the plates are sealingly received in the channels;

wherein the shell is constructed of a non-metallic corrosion resistant material; and wherein the first and second tube headers and tubes are constructed of metal materials having efficient heat transfer properties.

14. The heat exchanger of claim 13, wherein:

the first tube header sealing means includes at least one first header O-ring sealingly juxtaposed between the first tube header periphery and the shell;

the second tube header sealing means includes at least one second header O-ring sealingly juxtaposed between the second tube header periphery and the shell;

the first end cover sealing means includes at least one first end cover O-ring sealingly juxtaposed between the first end cover and the shell; and the second end cover sealing means includes at least one second end cover O-ring sealingly juxtaposed between the second end cover and the shell.

15. The heat exchanger of claim 13, wherein:

at least one tube header periphery includes a locating recess;

the shell includes at least one threaded locating hole through the shell wall; and the heat exchanger further comprises a locating screw extending between opposite proximal and distal ends, the locating screw threadably engaging the threaded locating hole, the locating screw proximal end engaging the locating recess, the locating screw being adapted to locate the tube bundle angularly about the shell central axis and longitudinally along the shell central axis in a predetermined alignment with the shell.

16. The heat exchanger of claim 15, wherein the locating screw is adapted to electrically ground the tube bundle to an external ground.

17. The heat exchanger of claim 13, further comprising:

an inner pin and socket locating means for locating and attaching the first and second flow separators to the first and second tube headers, respectively;

an outer pin and socket locating means for locating and attaching the first and second flow separators to the first and second end covers, respectively; and wherein the first and second resilient disc each includes a hole therethrough juxtaposed with the outer pin and socket locating means.

18. The heat exchanger of claim 17, wherein the tubes are arranged in a predetermined pattern having adjacent straight rows of tubes and the first and second flow separator plates further comprise:

an outer portion aligned with the shell central axis so as to be received in the channels; and an inner portion integral and in stepped relation with the outer portion transverse to the direction of the shell central axis, the inner portion being disposed between the adjacent straight rows of tubes so as to not obstruct tube coolant flow.

19. The heat exchanger of claim 13, further comprising:

a first shell coolant receiver and a second shell coolant receiver, the first and second shell coolant receivers being juxtaposed with the first and second shell coolant passageways respectively, each shell coolant receiver having a central axis, a body extending between upper and lower ends, a circular bore passing through the body and in communication with the shell cavity, a saddle-shaped flange encircling the body, the flange closely conforming to the shell, the body lower end having a pilot penetrating the shell, the flange and body being bonded to the shell;

a first shell coolant connector and a second shell coolant connector, each shell coolant connector having a central axis and a body extending between upper and lower ends, the body lower end having a pilot, the body upper end having a nozzle, the nozzle having an axis at an angle to the connector central axis of between zero and ninety degrees, the first shell coolant connector pilot being removably and rotatably received within the first shell connector receiver bore, and the second shell coolant connector pilot being removably and rotatably received within the second shell coolant receiver bore, each shell coolant connector having a circular bore passing through the body and in communication with the respective shell coolant receiver bore;

first shell coolant connector sealing means for rotatably sealing the first shell coolant connector to the first shell coolant receiver;

second shell coolant connector sealing means for rotatably sealing the second shell coolant connector to the second shell coolant receiver;

a first tube coolant receiver and a second tube coolant receiver, the first and second tube coolant receivers being juxtaposed with the first and second tube coolant passageways respectively, each tube coolant receiver having a central axis and a body extending between upper and lower ends, the first and second tube coolant receivers each having a circular bore passing through the body and in communication with the first and second chamber respectively;

a first tube coolant connector and a second tube coolant connector, each tube coolant connector having a central axis and a body extending between upper and lower ends, the body lower end having a pilot, the body upper end having a nozzle, the nozzle having an axis at an angle to the connector central axis of between zero and ninety degrees, the first tube coolant connector pilot being removably and rotatably received within the first tube coolant receiver bore, and the second tube coolant connector pilot being removably and rotatably received within the second tube coolant receiver bore, each tube coolant connector having a circular bore passing through the body and in communication with the respective tube coolant receiver bore;

first tube coolant connector sealing means for rotatably sealing the first tube coolant connector to the first tube coolant receiver;

second tube coolant connector sealing means for rotatably sealing the second tube coolant connector to the second tube coolant receiver, so as to allow connection of the nozzles to the external conduits in any orientation; and retaining means for retaining the connector pilot in the receiver bore, while allowing selective rotation of the connector about the connector central axis.

20. The heat exchanger of claim 19, wherein:

the first tube coolant receiver has a flange encircling the body;

the body lower end has a pilot penetrating the shell and the first chamber; and the first tube coolant receiver flange and pilot are bonded to the shell.

21. The heat exchanger of claim 19, wherein:

the second tube coolant receiver has a flange encircling the body;

the body lower end has a pilot penetrating the shell and the second chamber; and the second tube coolant receiver flange and pilot are bonded to the shell.

22. The heat exchanger of claim 19, wherein the first tube coolant receiver is integral with the first end cover.

23. The heat exchanger of claim 19, wherein the second tube coolant receiver is integral with the second end cover.

24. The heat exchanger of claim 19, wherein:

the first shell coolant connector sealing means includes at least one first shell coolant connector O-ring sealingly juxtaposed between the first shell coolant connector pilot and the first shell coolant receiver bore;

the second shell coolant connector sealing means includes at least one second shell coolant connector O-ring sealingly juxtaposed between the second shell coolant connector pilot and the second shell coolant receiver bore;

the first tube coolant connector sealing means includes at least one first tube coolant connector O-ring sealingly juxtaposed between the first tube coolant connector pilot and the first tube coolant receiver bore; and the second tube coolant connector sealing means includes at least one second tube coolant connector O-ring sealingly juxtaposed between the second tube coolant connector pilot and the second tube coolant receiver bore.

25. A shell and tube heat exchanger for transferring heat between a shell coolant and a tube coolant, the coolants being carried by external conduits, the heat exchanger having first and second shell coolant passageways and first and second tube coolant passageways to conduct the coolants, the heat exchanger comprising:

a shell, the shell having a central axis, the shell extending between opposite first and second ends, the shell having a wall extending around a periphery and defining a shell cavity therein, the first shell coolant passageway passing through the shell wall adjacent the shell first end, the second shell coolant passageway passing through the shell wall adjacent the shell second end;

a first tube header having an outer periphery, and a second tube header having an outer periphery, the first and second tube headers being spaced apart and generally parallel;

a plurality of generally straight and parallel tubes extending between the first and second tube headers, the tubes having first and second open ends attached to and penetrating the first and second tube headers, respectively;

wherein the first tube header, the second tube header, and the tubes comprise a tube bundle, the tube bundle being removably received within the shell cavity with the first tube header adjacent the shell first end, and the second tube header adjacent the shell second end;

a first end cover removably attached to the shell first end, the first end cover having an inside surface, and a second end cover removably attached to the shell second end, the second end cover having an inside surface;

wherein the shell cavity includes a first chamber extending between the first tube header and the first end cover, and the shell cavity includes a second chamber extending between the second tube header and the second end cover, the first and second tube coolant passageways being in communication with the first and second chambers respectively, and the tube first and second open ends being in communication with the first and second chambers respectively, so as to allow passage of the tube coolant between the first and second chambers through the tubes;

first tube header sealing means for slidably sealing the first tube header to the shell;

second tube header sealing means for slidably sealing the second tube header to the shell;

first end cover sealing means for sealing the first end cover to the shell;

second end cover sealing means for sealing the second end cover to the shell;

a first shell coolant receiver and a second shell coolant receiver, the first and second shell coolant receivers being juxtaposed with the first and second shell coolant passageways respectively, each shell coolant receiver having a central axis, a body extending between upper and lower ends, a circular bore passing through the body and in communication with the shell cavity, a saddle-shaped flange encircling the body, the flange closely conforming to the shell, the body lower end having a pilot penetrating the shell, the flange and body being bonded to the shell;

a first shell coolant connector and a second shell coolant connector, each shell coolant connector having a central axis and a body extending between upper and lower ends, the body lower end having a pilot, the body upper end having a nozzle, the nozzle having an axis at an angle to the connector central axis of between zero and ninety degrees, the first shell coolant connector pilot being removably and rotatably received within the first shell connector receiver bore, and the second shell coolant connector pilot being removably and rotatably received within the second shell coolant receiver bore, each shell coolant connector having a circular bore passing through the body and in communication with the respective shell coolant receiver bore;

first shell coolant connector sealing means for rotatably sealing the first shell coolant connector to the first shell coolant receiver;

second shell coolant connector sealing means for rotatably sealing the second shell coolant connector to the second shell coolant receiver;

a first tube coolant receiver and a second tube coolant receiver, the first and second tube coolant receivers being juxtaposed with the first and second tube coolant passageways respectively, each tube coolant receiver having a central axis and a body extending between upper and lower ends, the first and second tube coolant receivers each having a circular bore passing through the body and in communication with the first and second chamber respectively;

a first tube coolant connector and a second tube coolant connector, each tube coolant connector having a central axis and a body extending between upper and lower ends, the body lower end having a pilot, the body upper end having a nozzle, the nozzle having an axis at an angle to the connector central axis of between zero and ninety degrees, the first tube coolant connector pilot being removably and rotatably received within the first tube coolant receiver bore, and the second tube coolant connector pilot being removably and rotatably received within the second tube coolant receiver bore, each tube coolant connector having a circular bore passing through the body and in communication with the respective tube coolant receiver bore;

first tube coolant connector sealing means for rotatably sealing the first tube coolant connector to the first tube coolant receiver;

second tube coolant connector sealing means for rotatably sealing the second tube coolant connector to the second tube coolant receiver, so as to allow connection of the nozzles to the external conduits in any orientation;

retaining means for retaining the connector pilot in the receiver bore, while allowing selective rotation of the connector about the connector central axis;

wherein the shell is constructed for a non-metallic corrosion resistant material; and wherein the first and second tube headers and tubes are constructed of metal materials having efficient heat transfer properties.

26. The heat exchanger of claim 25, wherein:

the first tube coolant receiver has a flange encircling the body;

the body lower end has a pilot penetrating the shell and the first chamber; and the first tube coolant receiver flange and pilot are bonded to the shell.

27. The heat exchanger of claim 25, wherein:

the second tube coolant receiver has a flange encircling the body;

the body lower end has a pilot penetrating the shell and the second chamber; and the second tube coolant receiver flange and pilot are bonded to the shell.

28. The heat exchanger of claim 25, wherein the first tube coolant receiver is integral with the first end cover.

29. The heat exchanger of claim 25, wherein the second tube coolant receiver is integral with the second end cover.

30. The heat exchanger of claim 25, wherein:

the first shell coolant connector sealing means includes at least one first shell coolant connector O-ring sealingly juxtaposed between the first shell coolant connector pilot and the first shell coolant receiver bore;

the second shell coolant connector sealing means includes at least one second shell coolant connector O-ring sealingly juxtaposed between the second shell coolant connector pilot and the second shell coolant receiver bore;

the first tube coolant connector sealing means includes at least one first tube coolant connector O-ring sealingly juxtaposed between the first tube coolant connector pilot and the first tube coolant receiver bore; and the second tube coolant connector sealing means includes at least one second tube coolant connector O-ring sealingly juxtaposed between the second tube coolant connector pilot and the second tube coolant receiver bore.

31. The heat exchanger of claim 25, wherein:

at least one tube header periphery includes a locating recess;

the shell includes at least one threaded locating hole through the shell wall; and the heat exchanger further comprises a locating screw extending between opposite proximal and distal ends, the locating screw threadably engaging the threaded locating hole, the locating screw proximal end engaging the locating recess, the locating screw being adapted to locate the tube bundle angularly about the shell central axis and longitudinally along the shell central axis in a predetermined alignment with the shell.

32. The heat exchanger of claim 31, wherein the locating screw is adapted to electrically ground the tube bundle to an external ground.

33. The heat exchanger of claim 25, further comprising:

a first resilient disc disposed against the first end cover inside surface, the first resilient disc having a plurality of channels extending radially outward;

a second resilient disc disposed against the second end cover inside surface, the second resilient disc having a plurality of channels extending radially outward;

a first flow separator removably received within the first chamber, the first flow separator having a plurality of plates, the plates extending radially from unitary proximal ends adjacent the shell central axis outward to distal ends adjacent the shell, wherein the shell includes a plurality of grooves aligned with the shell central axis, the plates distal ends being received in the grooves, the plates extending axially from the first tube header to the first resilient disc wherein the plates are sealingly received in the channels; and a second flow separator removably received within the second chamber, the second flow separator having a plurality of plates, the plates extending radially from unitary proximal ends adjacent the shell central axis outward to distal ends adjacent the shell, wherein the shell includes a plurality of grooves aligned with the shell central axis, the plates distal ends being received in the grooves, the plates extending axially from the second tube header to the second resilient disc wherein the plates are sealingly received in the channels.

34. The heat exchanger of claim 33, further comprising:

an inner pin and socket locating means for locating and attaching the first and second flow separators to the first and second tube headers, respectively;

an outer pin and socket locating means for locating and attaching the first and second flow separators to the first and second end covers, respectively; and wherein the first and second resilient disc each includes a hole therethrough juxtaposed with the outer pin and socket locating means.

35. The heat exchanger of claim 34, wherein the tubes are arranged in a predetermined pattern having adjacent straight rows of tubes and the first and second flow separator plates further comprise:

an outer portion aligned with the shell central axis so as to be received in the channels; and an inner portion integral and in stepped relation with the outer portion transverse to the direction of the shell central axis, the inner portion being disposed between the adjacent straight rows of tubes so as to not obstruct tube coolant flow.

36. The heat exchanger of claim 25, wherein:

A first tube header sealing means includes at least one first header O-ring sealingly juxtaposed between the first tube header periphery and the shell;

the second tube header sealing means includes at least one second header O-ring sealingly juxtaposed between the second tube header periphery and the shell;

the first end cover sealing means includes at least one first end cover O-ring sealingly juxtaposed between the first end cover and the shell; and the second end cover sealing means includes at least one second end cover O-ring sealingly juxtaposed between the second end cover and the shell.

37. A shell and tube heat exchanger for transferring heat between a shell coolant and a tube coolant, the coolants being carried by external conduits, the heat exchangers having first and second shell coolant passageways and first and second tube coolant passageways to conduct the coolants, the heat exchanger comprising:

a shell, the shell having a central axis, the shell extending between opposite first and second ends, the shell having a wall extending around a periphery and defining a shell cavity therein, the first shell coolant passageway passing through the shell wall adjacent the shell first end, the second shell coolant passageway passing through the shell wall adjacent the shell second end, the shell having at least one threaded locating hole through the shell wall, the shell having a plurality of grooves within the shell cavity, the grooves being aligned with the shell central axis;

a first tube header having an outer periphery, and a second tube header having an outer periphery, the first and second tube headers being spaced apart and generally parallel, at least one tube header periphery having a locating recess;

a plurality of generally straight and parallel tubes extending between the first and second tube headers, the tubes having first and second open ends attached to and penetrating the first and second tube headers, respectively;

wherein the first tube header, the second tube header, and the tube comprise a tube bundle, the tube bundle being removably received within the shell cavity with the first tube header adjacent the shell first end, and the second tube header adjacent the shell second end, the tube header locating recess being juxtaposed with the threaded locating hole;

a locating screw extending between opposite proximal and distal ends, the locating screw threadably engaging the threaded locating hole, the locating screw proximal end engaging the locating recess, the locating screw being adapted to locate the tube bundle angularly about the shell central axis and longitudinally along the shell central axis in a predetermined alignment wit the shell, the locating screw being adapted to electrically ground the tube bundle to an external ground;

at least one first header O-ring sealingly juxtaposed between the first tube header periphery and the shell for slideably sealing the first tube header to the shell, and at least one second header O-ring sealingly juxtaposed between the second tube header periphery and the shell for slideably sealing the second tube header to the shell;

a first end cover removably attached to the shell first end, the first end cover having an inside surface, and a second end cover removably attached to the shell second end, the second end cover having an inside surface;

at least one first end cover O-ring sealingly juxtaposed between the first end cover and the shell for sealing the first end cover to the shell, and at least one second end cover O-ring sealingly juxtaposed between the second end cover and the shell for sealing the second end cover to the shell;

wherein the shell cavity includes a first chamber extending between the first tube header and the first end cover, and the shell cavity includes a second chamber extending between the second tube header and the second end cover, the first and second tube coolant passageways being in communication with the first and second chambers respectively, and the tube first and second open ends being in communication with the first and second chambers respectively, so as to allow passage of the tube coolant between the first and second chambers trough the tube;

a first resilient disc disposed against the first end cover inside surface, the first resilient disc having a plurality of channels extending radially outward, and a second resilient disc disposed against the second end cover inside surface, the second resilient disc having a plurality of channels extending radially outward;

a first flow separator removably received within the first chamber, the first flow separator having a plurality of plates, the plates extending radially from unitary proximal ends adjacent the shell central axis outward to distal ends adjacent the shell, the plates distal ends being received in the shell grooves, the plates extending axially from the first tube header to the first resilient disc wherein the plates are sealingly received in the channels;

a second flow separator removably received within the second chamber, the second flow separator having a plurality of plates, the plates extending radially from unitary proximal ends adjacent the shell central axis outward to distal ends adjacent the shell, the plates distal ends being received in the shell grooves, the plates extending axially from the second tube header to the second resilient disc wherein the plates are sealingly received in the channels;

an inner pin and socket locating means for locating and attaching the first and second flow separators to the first and second tube headers, respectively, and an outer pin and socket locating means for locating and attaching the first and second flow separators to the first and second end covers, respectively, wherein the first and second resilient disc each includes a hole therethrough juxtaposed with the outer pin and socket locating means;

a first shell coolant receiver and a second shell coolant receiver, the first and second shell coolant receivers being juxtaposed with the first and second shell coolant passageways respectively, each shell coolant receiver having a central axis, a body extending between upper and lower ends, a circular bore passing through the body and in communication with the shell cavity, a saddle-shaped flange encircling the body, the flange closely conforming to the shell, the body lower end having a pilot penetrating the shell, the flange and body being bonded to the shell;

a first shell coolant connector and a second shell coolant connector, each shell coolant connector having a central axis and a body extending between upper and lower ends, the body lower end having a pilot, the body upper end having a nozzle, the nozzle having an axis at an angle to the connector central axis of between zero and ninety degrees, the first shell coolant connector pilot being removably and rotatably received within the first shell coolant receiver bore, and the second shell coolant connector pilot being removing and rotatably received within the second shell coolant receiver bore, each shell coolant connector having a circular bore passing through the body and in communication with the respective shell coolant receiver bore;

at least one first shell coolant connector O-ring sealingly juxtaposed between the first shell coolant connector pilot and the first shell coolant receiver bore for rotatably sealing the first shell coolant connector to the first shell coolant receiver;

at least one second shell coolant connector O-ring sealingly juxtaposed between the second shell coolant connector pilot and the second shell coolant receiver bore for rotatably sealing the second shell coolant connector to the second shell coolant receiver;

a first tube coolant receiver and a second tube coolant receiver, the first and second tube coolant receivers being juxtaposed with the first and second tube coolant passageways respectively, each tube coolant receiver having a central axis and a body extending between upper and lower ends, the first and second tube coolant receivers each having a circular bore passing through the body and in communication with the first and second chambers respectively;

a first tube coolant connector and a second tube coolant connector, each tube coolant connector having a central axis and a body extending between upper and lower ends, the body lower end having a pilot, the body upper end having a nozzle, the nozzle having an axis at an angle to the connector central axis of between zero and ninety degrees, the first tube coolant connector pilot being removably and rotatably received within the first tube coolant receiver bore, and the second tube coolant connector pilot being removably and rotatably received within the second tube coolant receiver bore, each tube coolant connector having a circular bore passing through the body and in communication with the respective tube coolant receiver bore;

at least one first tube coolant connector O-ring sealingly juxtaposed between the first tube coolant connector pilot and the first tube coolant receiver bore for rotatably sealing the first tube coolant connector to the first tube coolant receiver;

at least one second tube coolant connector O-ring sealingly juxtaposed between the second tube coolant connector pilot and the second tube coolant receiver bore for rotatably sealing the second tube coolant connector to the second tube coolant receiver, so as to allow connection of the nozzles to the external conduits in any orientation;

retaining means for retaining the connector pilot in the receiver bore, while allowing selective rotation of the connector about the connector central axis;

wherein the shell is constructed of a non-metallic corrosion resistant material; and wherein the first and second tube headers and tubes are constructed of metal materials having efficient heat transfer properties.

* * * * *